United States Patent [19]

Zink

[11] 4,042,796

[45] Aug. 16, 1977

[54] INERTIA SWITCH FOR SENSING VIBRATION FORCES

[75] Inventor: Henry R. Zink, Lake Arrowhead, Calif.

[73] Assignee: Zink Enterprises Security Systems, San Bernardino, Calif.

[21] Appl. No.: 622,474

[22] Filed: Oct. 15, 1975

[51] Int. Cl.[2] ..... H01H 35/14

[52] U.S. Cl. ..... 200/61.45 R; 200/61.52; 200/61.93

[58] Field of Search ..... 200/61.45–61.53, 200/16 C, 16 D, 61.93, DIG. 29, 81 H

[56] References Cited

U.S. PATENT DOCUMENTS

| | | | |
|---|---|---|---|
| 1,662,979 | 3/1928 | Nelson | 200/61.52 |
| 1,719,742 | 7/1929 | Adams | 200/61.52 |
| 1,971,585 | 8/1934 | Soreng | 200/61.52 X |
| 2,716,168 | 8/1955 | Shonka | 200/61.52 X |
| 2,835,759 | 5/1958 | Waldow | 200/61.45 R X |
| 2,875,863 | 3/1959 | Prather | 200/61.45 R X |
| 2,892,049 | 6/1959 | Rubinstein | 200/61.52 X |
| 3,161,737 | 12/1964 | Hall | 200/61.52 |
| 3,560,680 | 2/1971 | Clarke | 200/61.45 R |
| 3,846,596 | 11/1974 | Wolf | 200/16 D |
| 3,899,784 | 8/1975 | McHenry | 200/61.93 X |
| 3,927,286 | 12/1975 | Fohl | 200/61.45 R |
| 3,973,095 | 8/1976 | Greene | 200/61.93 |
| 4,001,185 | 1/1977 | Mitsui et al. | 200/61.45 R |

*Primary Examiner*—James R. Scott
*Attorney, Agent, or Firm*—Dana E. Keech

[57] ABSTRACT

A delicately balanced but normally closed polished ball bearing sensor highly responsive to physical vibrations of its immediate environment having security significance. A ball bearing is confined within a cylindrical metal shell with a very slight clearance permitting free vibration of the ball within said shell and resting by gravity upon the rounded head of a metal electrode mounted axially in an epoxy block also confined within said shell, conductor leads being soldered to said shell and said electrode and the assembly being enveloped co-axially within an epoxy casting having a flat face covered by a waterproof pressure adhesive serving to secure the sensor to any smooth flat vertical surface whereby the sensor is mounted in upright vertical position.

3 Claims, 3 Drawing Figures

INERTIA SWITCH FOR SENSING VIBRATION FORCES

SUMMARY OF THE INVENTION

The present invention is provided for use in any type of alarm equipment in which it is desired that an electrical warning be transmitted to the system from any specific area in a property being protected to permit an attempted intrusion into the property within that area to be brought to the immediate attention of security officers located at a central post of authority.

The invention is particularly provided for use in the creation of a warning signal which is employed in the method of and apparatus for transmitting signals invented by me and disclosed in my co-pending application for U.S. patent Ser. No. 588,376 filed June 19, 1975.

The basic novel feature of my aforesaid method and apparatus is its use of a pre-existing alternating electric current for the transmission of signals from the immediate area where said signals originate to a relatively distant area at which said signals are received and employed in turning in an alarm, or for any other desirable purpose.

Among the specific objects of the vibration contact switch of the present invention are the following:

1. To provide an electric sensor which is highly sensitive to physical vibrations in a normally static structural element upon which the body of the switch is mounted, whereby a vibratory signal pattern of make-and-break electrical impulses will be set up in the circuit of the sensor and delivered to a transmitter of the aforesaid method of and apparatus for transmitting signals.

2. To provide such a vibration sensor which is relatively inexpensive to produce and yet will be highly efficient in operation and will be subject to very light wear so as to remain uniformly in good operative condition over long periods of use.

3. To provide such a vibration sensor which is completely dust proof and moisture proof.

4. To provide such a sensor which is relatively inconspicuous and is provided with means for mounting the same on a vertical hard flat surface of any normally static structural element, the vibrations of which it is desired to monitor.

DETAILED DESCRIPTION OF THE PREFERRED EMBODIMENT

Figure 1:
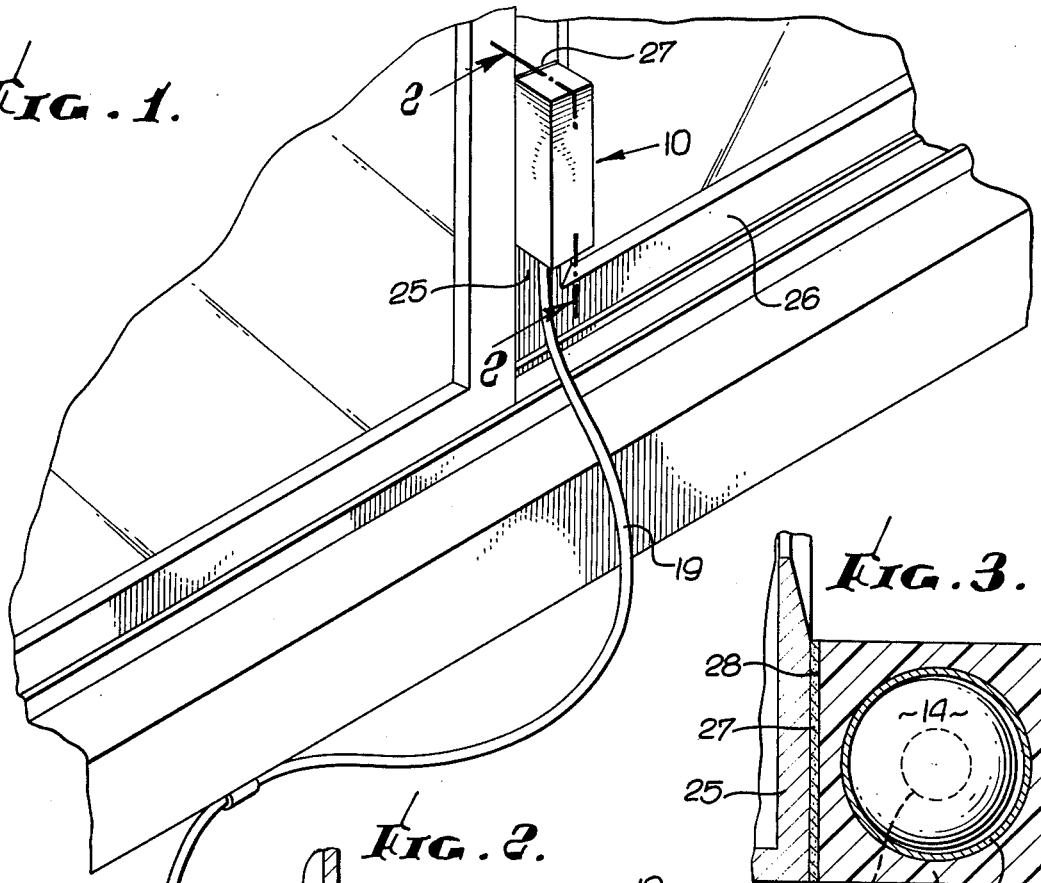
FIG. 1 is a diagrammatic perspective view illustrating a preferred embodiment of the present invention attached to the aluminum frame of a horizontally slideable window and with the sensor connected by a two-conductor flexible service cord to a transmitter of the aforesaid apparatus for transmitting signals which is plugged into a wall service outlet of a preexisting alternating electric current system so that signals originating in the senor are transmitted by said transmitter through said alternating electric current to a receiver of said apparatus (not shown) which is located at a relatively remote point in said alternating current system.
Figure 3:
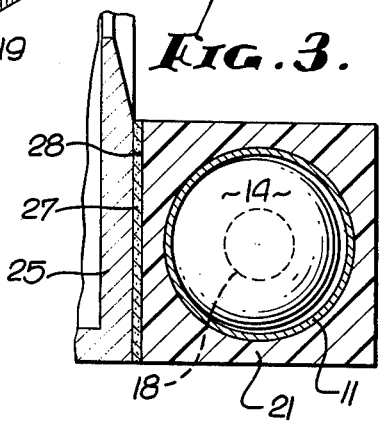
FIG. 3 is a cross sectional view taken on the line 3—3 of FIG. 2.

The vibration sensor 10 of the invention is preferably constructed as follows: The primary electrode 11 of the sensor consists of a cylindrical copper shell having an external diameter of 7/16 inch; an internal diameter of 25/64 inch; and a length of 1 1/16 inches. Opposite end portions of the shell 11 are swedged slightly inwardly at 12 and 13 to trap within one end of the shell a ball bearing 14 made of chromium or chrome steel or the like, and having an outside diameter of ⅝ inch. Closely fitting within the opposite end of the shell 11 is a cylindrical epoxy plug 15 having an outside diameter of 25/64 inch and a length of 5/16 inch. The plug 15 has an axial aperture 16 which snugly receives a brass secondary electrode 17 having a smooth hemispherical head 18 on which the ball 14 rests. The electrode 17 is preferably threaded and sealed in place in the aperture 16 so as to extend a short distance from the lower end thereof.

The sensor 10 is provided with a two-conductor plastic coated flexible service cord 19, the bare conductors of such cord at one end thereof being soldered respectively to the primary electrode 11 and the secondary electrode 17.

A suitable plastic cap 20 is applied adhesively to the inturned flange 12 at the upper end of the shell 11 and said shell, with the elements above described as being entrapped therein, are completely enclosed by an epoxy body 21 in the form of a rectangular parallelepipedon in which the shell 11 is co-axially centered. The sensor 10 is designed to most efficiently perform its function of transmitting vibratory signals when it is secured to a normally static element in which significant vibrations may occur such as the aluminum frame 25 of a sliding window 26 shown in FIG. 1 with the sensor 10 in a true vertical position and with the cord 19 extending downwardly from the sensor. Various types of securing means may be employed to effect this mounting of the sensor 10, the preferable means shown in the drawings being a coating of pressure adhesive 27 which is applied uniformly to one of the four uniform vertical faces 28 of the epoxy sensor body 21 and which is normally covered by a neutral paper cover (not shown) which is removed to accomplish the mounting of the sensor 10 as shown in FIG. 2 by pressing the adhesive coating 27 against window frame member 25.

Figure 2:
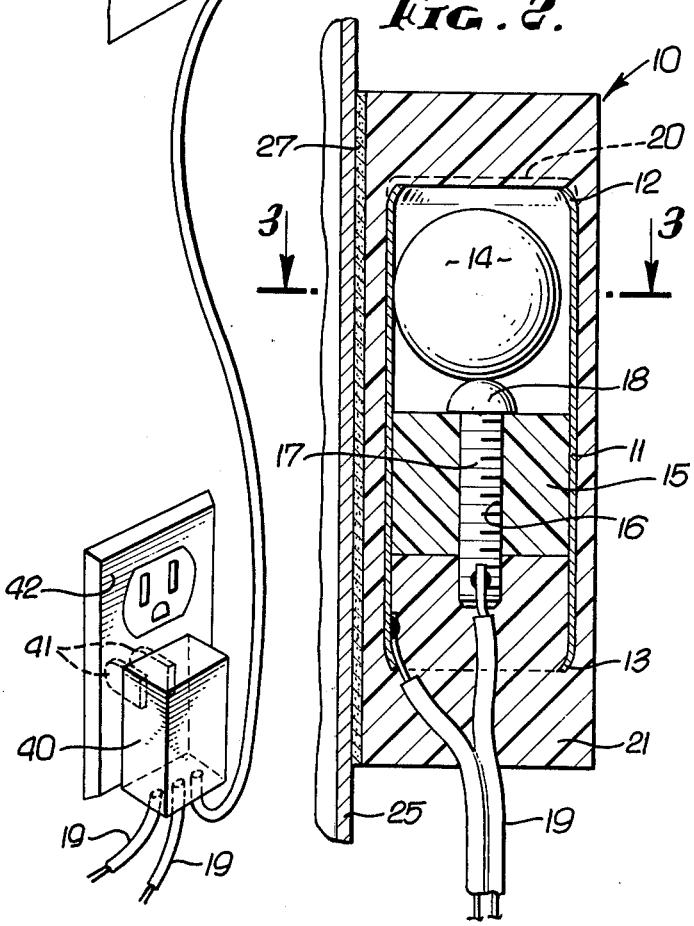
FIG. 2 is an enlarged vertical sectional view taken on the line 2—2 of FIG. 1 and illustrating the internal structure of the preferred embodiment of the vibration sensor of the present invention.

The ball bearing 14 (enlarged) is shown in FIG. 2 as poised in a normally closed position resting on and cocked slightly to one side of vertical alignment with the rounded head 18 of electrode 17 so as to form an electrical connection between said electrode and shell 11 although offering a very high resistance to the flow of current through said connection. However, the misalignment of the ball bearing 14 with the electrode 17 resulting from the very short distance the ball has to roll on the electrode head 18 in order to close the sensor circuit results in a subsequent breaking of this contact by only a very slight vibration of the window frame member 25 on which the sensor is mounted. The normal response of the sensor 10 therefore to such a vibration is the production of a rapid succession of electrical impulses imparted by successive opening and closing of the sensor circuit which reflects the rate of vibrations present in the window frame member 25 on which the sensor is mounted and greatly decreases the resistance offered by the sensor circuit.

It is thus clear that when the window 26 is undisturbed the sensor 10 maintains a continuously closed condition yet practically blocks an effective flow of current therethrough. Any change in the condition of the sensor from this position of respectively inactive repose indicates an unauthorized disturbance of the window 26. This disturbance could amount to only a gentle probing pressure against the window by an intruder seeking entrance. Nevertheless, this disturbance is sufficient to set up a series of rapid vibrations in the sensor 10 which would be transmitted through the two-conductor service cord 19 to a transmitter 40 of the aforesaid apparatus for transmitting signals disclosed in my co-pending application above referred to.

Transmitter 40 has a pair of electrical prongs 41 for connecting said transmitter with a pre-existing alternating current system by plugging the same into a conveniently located service outlet 42 of said system.

I claim:

1. In a security monitoring vibration sensor, the combination of:

a metal ball;

an axial metallic electrode means providing a tangential supporting contact with said ball from beneath, the area of said contact being concentrated approximately at the nadir of the vertical axis of said ball, said axial electrode means thus making a constantly good electrical connection with said ball, while shifting slideably horizontally relative to said ball, in responding rapidly to external vibrations, without substantially overcoming the inertia of said ball as to disturb its position of rest in which it is slideably supported on said axial electrode means by said contact;

a tubular metallic electrode means insulated from but rigidly attached to said axial electrode means and closely surrounding said ball to limit movements of said ball laterally, in any direction within said tubular metallic electrode means, to a relatively minute distance thereby producing, in response to minute lateral external vibration forces being imposed on said axial and tubular electrode means, a rapid oscillation of said ball with the latter rebounding from opposite sides of said tubular metallic electrode means, to produce a strong warning electric signal at each terminal point of said oscillation;

means providing opposite phase terminals leading respectively from said axial and tubular electrode means;

means providing an insulating enclosing structure for said sensor; and means for securing the sensor in vertical position on a building the security of which is being monitored.

2. A combination as recited in claim 1 wherein said axial electrode means has a rounded convex head thereby causing said ball to gravitate into a very light contact with said tubular electrode means when not agitated by vibrations incurred by an attempted intrusion of the aforesaid building, whereby the circuit of said sensor will always be nominally closed, when undisturbed, but through such a poor electrical connection as to present a very high resistance to the transmission of current through the sensor circuit and thus economically performing a full time watch against intrusion and instantly adequate in its response to vibrations at a level generally indicative of a hostile probing of the premises being monitored, to transmit sufficient current to effect an alarm.

3. A combination as recited in claim 1 wherein a. said tubular electrode means comprise a cylindrical metallic shell, b. said ball is approximately three eighths of an inch in diameter, and c. the I.D. of said shell is approximately twenty-five sixty-fourths of an inch.

* * * * *